US007721691B2

(12) United States Patent
Tateno

(10) Patent No.: US 7,721,691 B2
(45) Date of Patent: May 25, 2010

(54) VARIABLE VALVE MECHANISM FOR INTERNAL COMBUSTION ENGINE

(75) Inventor: Manabu Tateno, Sunto-Gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 340 days.

(21) Appl. No.: 11/989,567

(22) PCT Filed: Oct. 31, 2006

(86) PCT No.: PCT/JP2006/322208

§ 371 (c)(1),
(2), (4) Date: Jan. 28, 2008

(87) PCT Pub. No.: WO2007/058092

PCT Pub. Date: May 24, 2007

(65) Prior Publication Data

US 2009/0255494 A1 Oct. 15, 2009

(30) Foreign Application Priority Data

Nov. 14, 2005 (JP) ..... 2005-328885

(51) Int. Cl.
*F01L 1/34* (2006.01)

(52) U.S. Cl. ..... 123/90.16; 123/90.31; 123/90.44; 74/569; 475/7

(58) Field of Classification Search ..... 123/90.16, 123/90.27, 90.31, 90.39, 90.44, 90.15, 90.17, 123/90.18; 74/559, 567, 569; 475/7, 228; 464/1, 2, 160
See application file for complete search history.

(56) References Cited

U.S. PATENT DOCUMENTS

| | | | | |
|---|---|---|---|---|
| 5,680,837 | A | 10/1997 | Pierik | |
| 6,019,076 | A | 2/2000 | Pierik et al. | |
| 6,360,705 | B1 | 3/2002 | Raghavan et al. | |
| 7,441,521 | B2 * | 10/2008 | Asada et al. | 123/90.16 |

FOREIGN PATENT DOCUMENTS

| | | | |
|---|---|---|---|
| DE | 103 39 658 | A1 | 3/2005 |
| EP | 1 574 679 | A2 | 9/2005 |
| EP | 1 717 428 | A1 | 11/2006 |
| JP | A-2000-234507 | | 8/2000 |
| JP | A-2002-349215 | | 12/2002 |
| JP | A-2005-256767 | | 9/2005 |
| WO | WO 03/069134 | A1 | 8/2003 |
| WO | WO 2005/059321 | A1 | 6/2005 |

* cited by examiner

*Primary Examiner*—Ching Chang
(74) *Attorney, Agent, or Firm*—Oliff & Berridge, PLC

(57) ABSTRACT

A worm gear is connected to an actuator and a worm wheel is connected to a control shaft. The worm wheel has teeth formed only on a predetermined angular range thereof. The above-referenced angular range includes a required rotational range of the control shaft. The worm wheel is formed to be brought out of mesh with the worm gear outside the predetermined angular range.

12 Claims, 9 Drawing Sheets

Valve opening
Valve closing
120
122
172
174
112
156
150
132
162
166
164
152a
152b
110
102
106
104

VARIABLE VALVE MECHANISM FOR INTERNAL COMBUSTION ENGINE

TECHNICAL FIELD

The present invention relates to a variable valve mechanism that allows a maximum lift amount of a valve to be varied using a variable mechanism. More particularly, the present invention relates to a variable valve mechanism that has a control shaft operating a variable mechanism connected via a worm gear mechanism to an actuator rotatably driving the control shaft.

BACKGROUND ART

A known variable valve mechanism, as that disclosed, for example, in Japanese Patent Laid-open No. 2000-234507, varies a maximum lift amount and open/close timing of a valve according to an engine operating condition. The variable valve mechanism disclosed in Japanese Patent Laid-open No. 2000-234507 includes a variable mechanism and an actuator. The variable mechanism varies the maximum lift amount and open/close timing of a valve according to an angular position of a control shaft. The actuator controls the angular position of the control shaft. The actuator is connected to the side of a worm gear of a worm gear mechanism. The control shaft is connected to the side of a worm wheel of the worm gear mechanism. Accordingly, rotation of the actuator is inputted to the control shaft with rotational speed thereof being reduced by the worm gear mechanism.

The known variable valve mechanism cited above includes a restriction mechanism that restricts maximum angular positions of the control shaft in forward and backward rotation. The restriction mechanism includes a restriction pin that rotates integrally with the worm wheel and a restriction member fixed to an accommodation cover of the worm gear mechanism. The restriction pin abuts on the restriction member, so that the worm wheel is prevented from further rotating. The maximum angular position of the control shaft is thereby restricted. In addition, an elastic body is integrally fixed to the restriction member to absorb impact that would otherwise be received when the restriction pin contacts the restriction member.

Including the above-mentioned document, the applicant is aware of the following documents as a related art of the present invention.

Japanese Patent Laid-open No. 2000-234507

Japanese Patent Laid-open No. 2002-349215

DISCLOSURE OF THE INVENTION

In the aforementioned known variable valve mechanism, however, the actuator can be rotated to exceed a limit amount because of a system failure or the like. In such cases, though the angular position of the worm wheel is directly restricted by the restriction mechanism, the maximum angular position of the worm gear can only be indirectly restricted by the worm wheel. Consequently, a screw-in action of the worm gear has causes the worm gear to be in excessive mesh with the worm wheel, resulting at times in a locked-up or damaged worm gear mechanism.

The present invention addresses these problems discussed above and it is an object of the present invention to provide, for a variable valve mechanism that has a control shaft operating a variable mechanism connected via a worm gear mechanism to an actuator rotatably driving the control shaft, a structure that can prevent the worm gear mechanism from being locked up or damaged by an excessive rotation of the actuator and the variable valve mechanism from being damaged by an excessive rotation of the control shaft.

In accomplishing the above object, according to a first aspect of the present invention, there is provided a variable valve mechanism for an internal combustion engine comprising: a variable mechanism for varying a maximum lift amount of a valve according to an angular position of a control shaft; and an actuator connected to the control shaft via a worm gear mechanism, the variable valve mechanism varying the maximum lift amount of the valve by rotatably driving the control shaft via the worm gear mechanism using the actuator; wherein the worm gear mechanism includes a worm gear connected to the actuator and a worm wheel connected to the control shaft; and wherein the worm wheel has teeth that are in mesh with the worm gear over a predetermined angular range including a required rotational range of the control shaft and is formed to be brought out of mesh with the worm gear outside the predetermined angular range.

According to the first aspect of the present invention, the worm wheel has the teeth that are in mesh with the worm gear over a predetermined angular range thereof. If the actuator rotates to exceed a limit amount as a result of a system failure or the like, a point of contact between the worm wheel and the worm gear exceeds the predetermined angular range, which brings the worm wheel and the worm gear out of mesh with each other. This shuts off an input of rotation from the worm gear to the worm wheel. A locked-up or damaged worm gear mechanism as a result of screw-in action of the worm gear or a damaged variable valve mechanism as a result of excessive rotation of the control shaft can be prevented.

According to a second aspect of the present invention, there is provided the variable valve mechanism as described in the first aspect, wherein the required rotational range of the control shaft includes an angular range of the control shaft ranging from an angular position that corresponds to a minimum setting value of the maximum lift amount of the valve to an angular position that corresponds to a maximum setting value thereof; and wherein the predetermined angular range is set such that, when the control shaft rotates in a small lift direction to exceed the angular position associated with the minimum setting value, the worm wheel and the worm gear are brought out of mesh with each other before the maximum lift amount of the valve reaches a minimum limit value required for achieving a marginal amount of intake air that allows an optimum operating condition of the internal combustion engine to be maintained.

According to the second aspect of the present invention, even if the control shaft rotates in the small lift direction to exceed the angular position associated with the minimum setting value of the maximum lift amount of the valve as a result of the actuator's rotating to exceed the limit amount because of a system failure or the like, the worm wheel and the worm gear are brought out of mesh with each other before the maximum lift amount of the valve reaches the minimum limit value. This prevents the control shaft from rotating any further. Accordingly, the maximum lift amount of the valve can be prevented from becoming smaller than the minimum limit value, thus achieving the marginal amount of intake air that allows an optimum operating condition of the internal combustion engine to be maintained.

According to a third aspect of the present invention, there is provided the variable valve mechanism as described in the first aspect, wherein the required rotational range of the control shaft includes an angular range of the control shaft ranging from an angular position that corresponds to a minimum setting value of the maximum lift amount of the valve to an angular position that corresponds to a maximum setting value thereof; and wherein the predetermined angular range is set such that, when the control shaft rotates in a large lift direction to exceed the angular position associated with the maximum setting value, the worm wheel and the worm gear are brought out of mesh with each other before the maximum lift amount of the valve reaches a maximum limit value that can prevent a collision between the valve and a piston.

According to the third aspect of the present invention, even if the control shaft rotates in the large lift direction to exceed the angular position that corresponds to the maximum setting value of the maximum lift amount of the valve as a result of the actuator's rotating to exceed the limit amount because of a system failure or the like, the worm wheel and the worm gear are brought out of mesh with each other before the maximum lift amount of the valve reaches the maximum limit value. This prevents the control shaft from rotating any further. Accordingly, the maximum lift amount of the valve can be prevented from becoming larger than the maximum limit value, thus avoiding a collision between the valve and the piston.

According to a fourth aspect of the present invention, there is provided the variable valve mechanism as described in the first aspect, wherein the variable mechanism includes: a rocking member that rocks about an axis disposed in parallel with a camshaft; a rocking cam surface formed on the rocking member, the rocking cam surface coming in contact with a valve support member supporting the valve to press the valve in a lift direction; a slide surface formed on the rocking member so as to oppose to a cam; an intermediate member sandwiched between the cam and the slide surface; and an operative coupling mechanism that varies a position of the intermediate member on the slide surface through operative coupling with rotation of the control shaft, wherein the predetermined angular range is set such that the worm wheel and the worm gear are brought out of mesh with each other before the position of the intermediate member on the slide surface reaches an extreme end of the slide surface when the control shaft rotates to exceed the required rotational range.

According to the fourth aspect of the present invention, even if the control shaft rotates to exceed the required rotational range as a result of the actuator's rotating to exceed the limit amount because of a system failure or the like, the worm wheel and the worm gear are brought out of mesh with each other before the position of the intermediate member on the slide surface reaches the extreme end of the slide surface. This prevents the control shaft from rotating any further. This prevents the intermediate member from exceeding the extreme end of the slide surface so that the intermediate member may not fall off the space between the cam and the slide surface.

According to a fifth aspect of the present invention, there is provided the variable valve mechanism as described in any one of the first through fourth aspects, further including: an urge means for urging the worm wheel toward a side, in which teeth of the worm wheel are engaged with the worm gear, if the worm wheel and the worm gear are brought out of mesh with each other as a result of an excessive rotation of the worm wheel.

According to the fifth aspect of the present invention, the worm wheel has teeth thereof engaged with the worm gear even if the worm wheel and the worm gear are brought out of mesh with each other. The worm wheel can therefore be brought into mesh with the worm gear by turning the worm gear in a backward direction. This allows the control shaft to be rotated again via the worm gear mechanism, making it possible to resume the operation of the variable valve mechanism quickly.

According to a sixth aspect of the present invention, there is provided the variable valve mechanism as described in the fifth aspect, wherein the urge means includes: a first spring that urges the worm wheel in the small lift direction with a spring force according to an amount of rotation of the worm wheel in the large lift direction; and a second spring that urges the worm wheel in the large lift direction with a spring force according to an amount of rotation of the worm wheel in the small lift direction.

According to the sixth aspect of the present invention, by using a spring as a means for urging the worm wheel, the worm wheel can be urged with an urging force according to the amount of rotation of the worm wheel in the direction opposite to the direction of rotation. This prevents an excessive force from acting between the worm wheel and the worm gear while the two are in mesh with each other. The worm wheel and the worm gear can also be reliably brought into mesh with each other, should the two are brought out of mesh with each other.

According to a seventh aspect of the present invention, there is provided the variable valve mechanism as described in any one of the first through sixth aspects, further including: an angular position sensor for producing an output of a signal in response to an angular position of the control shaft; a control means for controlling the actuator such that the angular position of the control shaft is made to coincide with a target angular position based on the signal of the angular position sensor; a switch a signal of which is changed before and after a predetermined reference angular position when the control shaft rotates; and a correction means for correcting the signal of the angular position sensor based on deviation between a signal to be outputted from the angular position sensor when the control shaft is at the reference angular position and a signal actually outputted from the angular position sensor when the signal of the switch changes.

According to the seventh aspect of the present invention, a signal correction is made with reference to a change in the switch signal when the actuator is to be controlled based on the signal of the angular position sensor. This can prevent the angular position of the control shaft from being deviated due to deviation in the signal of the angular position sensor. Consequently, the control shaft can be prevented from being rotated in excess of the required rotational range as affected by deviation in the signal of the angular position sensor due to a voltage drop or the like.

According to an eighth aspect of the present invention, there is provided the variable valve mechanism as described in any one of the first through sixth aspects, further including: an angular position sensor for producing an output of a signal in response to an angular position of the control shaft; a control means for controlling the actuator such that the angular position of the control shaft is made to coincide with a target angular position based on the signal of the angular position sensor; and a correction means for correcting the signal of the angular position sensor based on the relationship between the magnitude of a power supplied to the actuator and the signal of the angular position sensor.

According to the eighth aspect of the present invention, a signal correction is made with reference to the magnitude of the power supplied to the actuator when the actuator is to be controlled based on the signal of the angular position sensor. This can prevent the angular position of the control shaft from being deviated due to deviation in the signal. Consequently, the control shaft can be prevented from being rotated in excess of the required rotational range as affected by deviation in the signal of the angular position sensor due to a voltage drop or the like.

In accomplishing the above object, according to a ninth aspect of the present invention, there is provided a drive system including a worm gear mechanism reducing a rotational speed of an actuator and a drive shaft outputting rotation with a reduced speed, wherein the worm gear mechanism includes a worm gear connected to the actuator and a worm wheel connected to the drive shaft; and wherein the worm wheel has teeth formed thereon only for a predetermined angular range including a required rotational range of the drive shaft, with which the worm gear meshes, and the worm wheel is brought out of mesh with the worm gear over any ranges outside the predetermined angular range.

According to the ninth aspect of the present invention, the worm wheel has teeth formed thereon only for a predetermined angular range. If the actuator rotates to exceed the limit amount as a result of a system failure or the like, the point of contact between the worm wheel and the worm gear exceeds the predetermined angular range, thus bringing the worm wheel and the worm gear out of mesh with each other. This shuts off an input of rotation from the worm gear to the worm wheel. A locked-up or damaged worm gear mechanism as a result of screw-in action of the worm gear or a damaged element being driven as a result of excessive rotation of the drive shaft can be prevented. It is to be noted that the drive system according to the ninth aspect of the present invention is applicable to not only the variable valve mechanism for the internal combustion engine, but also any mechanism or system to be driven having a limited angular range of an input shaft (drive shaft).

According to a tenth aspect of the present invention, there is provided the drive system as described in the ninth aspect, further including: an urge means for urging the worm wheel toward a side, in which the teeth of the worm wheel are engaged with the worm gear when the worm wheel and the worm gear are brought out of mesh with each other as a result of an excessive rotation of the worm wheel.

According to the tenth aspect of the present invention, the teeth of the worm wheel remain engaged with the worm gear even when the worm wheel and the worm gear are brought out of mesh with each other. By rotating the worm gear in the opposite direction, therefore, the worm wheel and the worm gear can be once again brought in mesh with each other. This allows the control shaft to be rotated again via the worm gear mechanism, making it possible to resume the operation of the element to be driven quickly.

BEST MODE FOR CARRYING OUT THE INVENTION

First Embodiment

A first embodiment of the present invention will be described below with reference to FIGS. 1 through 7B.

General Structure of the Variable Valve Mechanism According to this Embodiment

Figure 1:
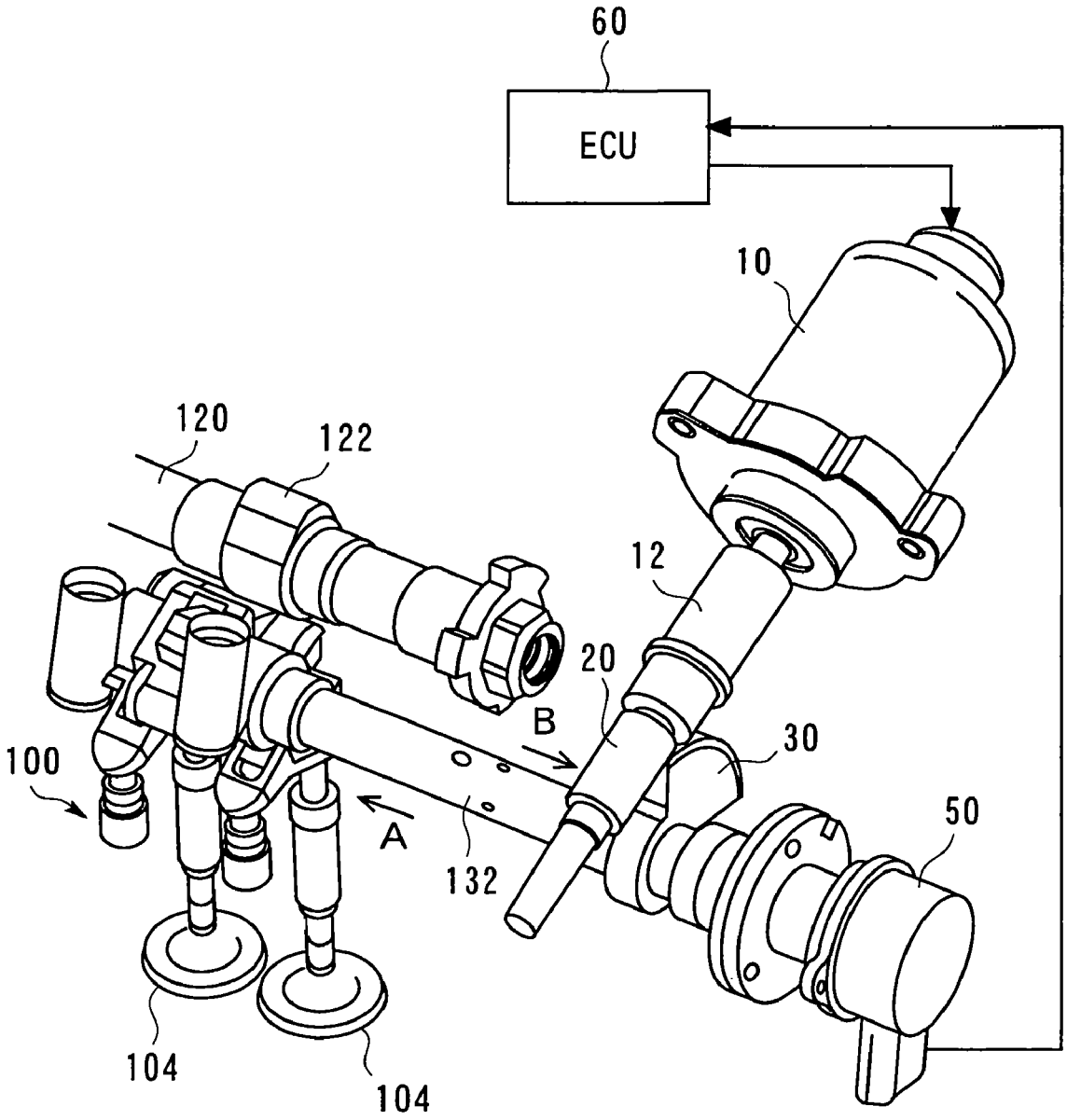
FIG. 1 is a perspective view for illustrating a general structure of a variable valve mechanism according to a first embodiment of the present invention.

FIG. 1 is a perspective view showing a general structure of a variable valve mechanism according to the first embodiment of the present invention. Referring to FIG. 1, a variable valve mechanism 100 according to the embodiment of the present invention is interposed between a camshaft 120 and intake valves 104. The variable valve mechanism 100 operatively couples a rotational movement of a cam 122 to a vertical movement of the intake valves 104. The variable valve mechanism 100 includes a control shaft 132 that is disposed in parallel with the camshaft 120. Varying an angular position of the control shaft 132 allows an operative coupling condition to be changed between the rotational movement of the cam 122 and the vertical movement of the intake valves 104, which, in turn, varies an acting angle and a maximum lift amount of the intake valves 104.

An internal combustion engine has the variable valve mechanism 100 for each cylinder though they are omitted in FIG. 1. For example, for an inline four-cylinder engine, four variable valve mechanisms 100 are disposed in series with the camshaft 120. Only one control shaft 132 is disposed in parallel with the camshaft 120 and the variable valve mechanism 100 of each cylinder shares this control shaft 132. Accordingly, the variable valve mechanisms 100 for all four cylinders are simultaneously controlled by controlling the angular position of this single control shaft 132, so that the acting angles and the maximum lift amounts of all intake valves 104 can be varied simultaneously.

The control shaft 132 is rotatably driven by a motor 10 that serves as an actuator. A worm wheel 30 is secured to an end portion of the control shaft 132. A worm gear 20 fixed to an output shaft 12 of the motor 10 is in mesh with the worm wheel 30. The worm wheel 30 and the worm gear 20 constitute a gear mechanism (worm gear mechanism). Rotation of the motor 10 is inputted to the worm wheel 30 via the worm gear 20. This varies the angular position of the control shaft 132, which simultaneously achieves changing of the acting angles and the maximum lift amounts of all intake valves 102.

The variable valve mechanism 100 according to the embodiment of the present invention is characterized in arrangements of the worm wheel 30, which will be detailed later.

Rotation of the motor 10 is controlled by an ECU (Electronic Control Unit) 60 that provides an overall control of the internal combustion engine. The ECU 60 controls a rotational movement of the motor 10 by using a signal outputted from a lift sensor 50 as a reference signal. The lift sensor 50 is an angular position sensor mounted on an end of the control shaft 132. The lift sensor 50 produces an output of a signal according to the angular position of the control shaft 132.

Detailed Arrangement of Variable Valve Mechanism

The arrangement of the variable valve mechanism 100 will be described in detail below.

Figure 2:
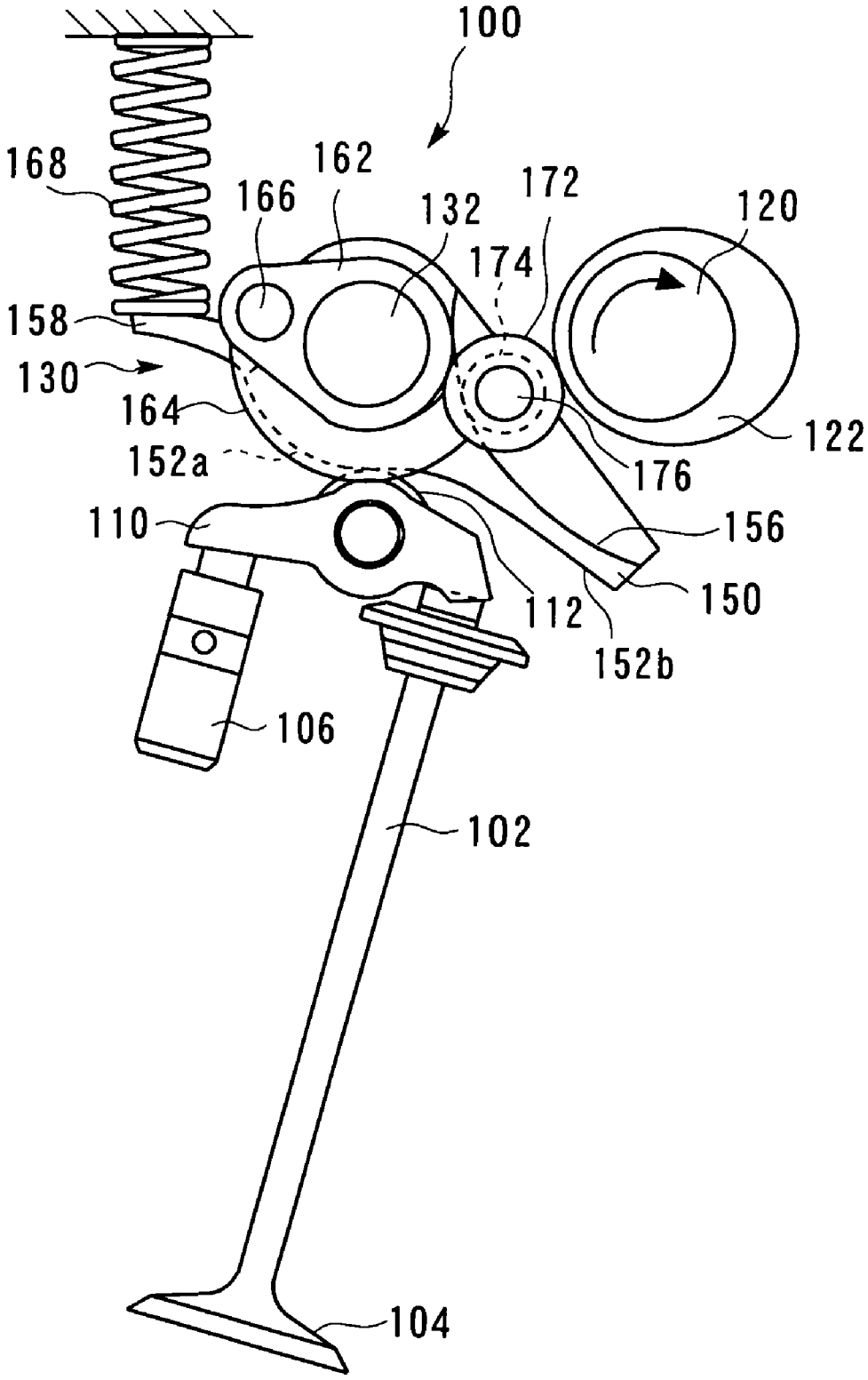
FIG. 2 is a view showing the variable valve mechanism as viewed from the direction of arrow A in FIG. 1.

FIG. 2 is a view showing the variable valve mechanism 100 as viewed from the direction of arrow A that extends in parallel with an axis of the control shaft 132 in FIG. 1. As shown in FIG. 2, the intake valve 104 is supported by a rocker arm 110 in the variable valve mechanism 100. A variable mechanism 130 is interposed between the cam 122 and the rocker arm 110. The variable mechanism 130 operatively couples a rocking movement of the rocker arm 110 to a rotational movement of the cam 122. The variable mechanism 130 is capable of continuously changing an operative coupling condition between the rotational movement of the cam 122 and the rocking movement of the rocker arm 110. The variable valve mechanism 100 is adapted to variably control the variable mechanism 130 so as to change a rocking movement and rocking timing of the rocker arm 110, thereby continuously changing valve opening characteristics of the intake valve 104 including the maximum lift amount, acting angle, and valve timing.

The variable mechanism 130 includes the aforementioned control shaft 132. A control arm 162 is secured to the control shaft 132. The control arm 162 protrudes in a radial direction of the control shaft 132. An arcuate link arm 164 is fitted to the protrusion. The link arm 164 has a proximal end portion rotatably connected to the control arm 162 by a pin 166. The pin 166 is eccentric from a center of the control shaft 132, serving as a fulcrum of rocking motion of the link arm 164.

In addition, a rocking cam arm 150 is rockably supported on the control shaft 132. The rocking cam arm 150 is disposed in pair so as to sandwich the control arm 162. The internal combustion engine according to the embodiment of the present invention includes two intake valves 104 for each cylinder, though they are omitted in FIG. 2. Accordingly, the variable valve mechanism 100 is arranged so as to drive two intake valves 104. The rocking cam arm 150 is disposed in association with each of the intake valves 102.

The rocking cam arm 150 is disposed such that a leading end thereof is oriented toward an upstream side in the direction of rotation of the cam 122. In accordance with the embodiment of the present invention, the camshaft 120 rotates in a clockwise direction as shown by an arrow in FIG. 2. The rocking cam arm 150 includes a slide surface 156 formed on a side thereof opposing the cam 122. The slide surface 156 contacts a second roller 174 to be described later. The slide surface 156 is curved mildly toward the side of the cam 122 and is formed such that the distance from a center of the cam 122 becomes greater at farther distances from a center of the control shaft 132 as the center of rocking.

A rocking cam surface 152 (152*a*, 152*b*) is formed on a side of the rocking cam arm 150 opposite the slide surface 156. The rocking cam surface 152 includes a non-acting face 152*a* and an acting face 152*b*. The non-acting face 52*a* is a peripheral surface of a cam base circle and formed with a constant distance from the center of the control shaft 132. The acting face 152*b* is formed on a leading end side of the rocking cam arm 150 so as to be connected and continued smoothly into the non-acting face 152*a*. The acting face 152*b* is formed such that the distance from the center of the control shaft 132 (i.e., a cam height) becomes greater toward the leading end of the rocking cam arm 150. When the non-acting face 152*a* is not differentiated from the acting face 152*b* in this specification, the face will be simply referred to as the rocking cam surface 152.

A first roller 172 and the second roller 174 are disposed between the slide surface 156 of the rocking cam arm 150 and a surface of the cam 122. Both the first roller 172 and the second roller 174 are rotatably supported on a coupling shaft 176 secured to a leading end portion of the aforementioned link arm 164. The second roller 174 is provided for each of the rocking cam arms 150. The first roller 172 is disposed between the pair of second rollers 174. The first roller 172 is in contact with the cam 122, while the second roller 174 is in contact with the slide surface 156 of the corresponding rocking cam arm 150. The link arm 164 can pivots about the pin 166. Accordingly, the first and second rollers 172, 174 can rock along the slide surface 156 and the surface of the cam 122, respectively, while keeping a predetermined distance from the pin 166. In accordance with the embodiment of the present invention, the control arm 162 and the link arm 164 constitute an operative coupling mechanism that varies the position of the second roller 174 on the slide surface 156 through operative coupling with rotation of the control shaft 132.

The rocking cam arm 150 includes a spring seat 158 formed therein. A lost motion spring 168 having a distal end fixed to a stationary portion of the internal combustion engine is hooked onto the spring seat 158. The lost motion spring 168 according to the embodiment of the present invention is a compression spring. An urging force from the lost motion spring 168 acts as an urging force pressing the slide surface 156 up against the second roller 174. The urging force also acts as an urging force pressing the first roller 172 coaxially integrated with the second roller 174 up against the cam 122. As a result, the first roller 172 and the second roller 174 are positioned correctly by being sandwiched from both sides between the slide surface 156 and the cam 122.

The above-referenced rocker arm 110 is disposed downward of the rocking cam arm 150. The rocker arm 110 includes a rocker roller 112 disposed so as to oppose the rocking cam surface 152. The rocker roller 112 is rotatably mounted at a middle portion of the rocker arm 110. The rocker arm 110 has a first end, to which a valve shaft 102 that supports the intake valve 104 is mounted. The rocker arm 110 also has a second end supported rotatably by a hydraulic lash adjuster 106. The valve shaft 102 is urged in a closing direction, i.e., a direction of pushing up the rocker arm 110 by a valve spring not shown. Further, the rocker roller 112 is pressed against the rocking cam surface 152 of the rocking cam arm 150 by this urging force and the hydraulic lash adjuster 106.

Figures 3A, 3B:
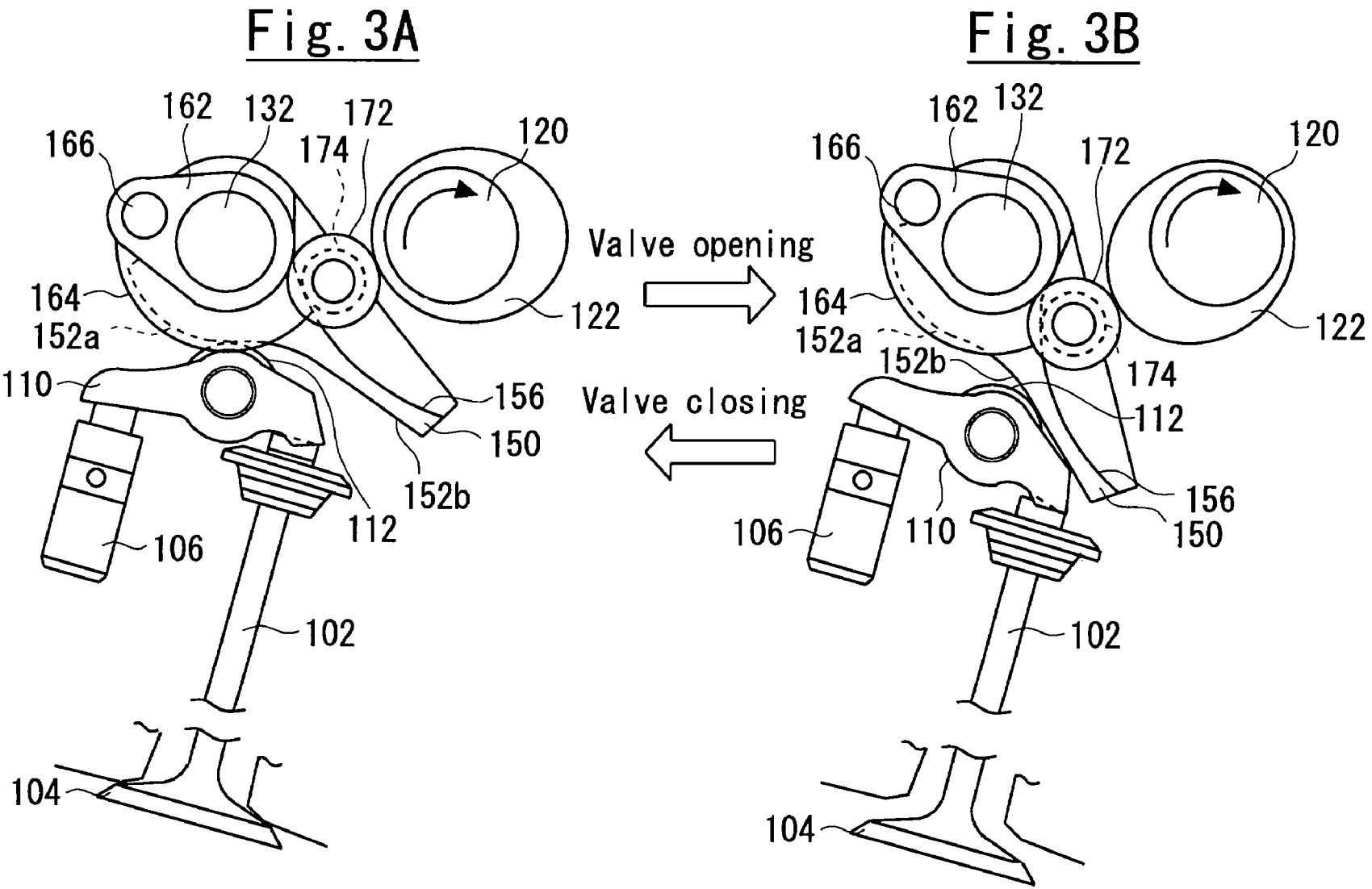
FIGS. 3A and 3B are views showing lift operations of the variable valve mechanism, FIG. 3A showing a condition of the variable valve mechanism, in which a valve is closed and FIG. 3B showing a condition of the variable valve mechanism, in which the valve is open.

Operation of Variable Valve Mechanism (1) Lift Operation of the Variable Valve Mechanism The lift operation of the variable valve mechanism 100 will be described with reference to FIGS. 3A and 3B. FIG. 3A is a view showing a condition of the variable valve mechanism, in which the intake valve 104 is closed in a process of lift operation. FIG. 3B is a view showing a condition of the variable valve mechanism, in which the intake valve 104 is fully open in the process of lift operation.

In the variable valve mechanism 100, the rotational movement of the cam 122 is first inputted to the first roller 172 that is in contact therewith. The first roller 172, together with the second roller 174 coaxially integrated therewith, rocks about the pin 166. This rocking movement is inputted to the slide surface 156 of the rocking cam arm 150 that supports the second roller 174. The slide surface 156 is pressed up against the second roller 174 at all times by the urging force of the lost motion spring. Accordingly, the rocking cam arm 150 rocks about the control shaft 132 according to the rotation of the cam 122 transmitted thereto via the second roller 174.

More specifically, when the camshaft 120 rotates from the condition shown in FIG. 3A, a point of contact of the first roller 172 on the cam 122 approaches a vertex portion of the cam 122 as shown in FIG. 3B. The first roller 172 is then relatively pressed downward by the cam 122 and the slide surface 156 of the rocking cam arm 150 is pressed down by the second roller 174 integrated with the first roller 172. As a result, the rocking cam arm 150 is rotated in the clockwise direction in FIG. 3B about the control shaft 132.

Rotation of the rocking cam arms 150 shifts a position of contact of the rocker roller 112 on the rocking cam surface 152 from the non-acting face 152*a* to the acting face 152*b*. This presses down the rocker arm 110 according to the distance of the acting face 152*b* from the center of the control shaft 132, causing the rocker arm 110 to rock in the clockwise direction about the point of support by the hydraulic lash adjuster 106. As a result, the intake valve 104 is pressed down by the rocker arm 110 and opened. Referring to FIG. 3B, a rotation amount of the rocking cam arm 150 becomes the greatest when the position of contact of the first roller 172 on the cam 122 reaches the vertex portion of the cam 122. At the same time, the lift amount of the intake valve 104 becomes the greatest in this case.

As the camshaft 120 further rotates, the position of contact of the first roller 172 on the cam surface 124 moves past the vertex portion of the cam 122. Then, the rocking cam arm 150 is rotated this time in a counterclockwise direction in FIG. 3B about the control shaft 132 by the urging force of the lost motion spring and the valve spring. Rotation of the rocking cam arm 150 in the counterclockwise direction moves the position of contact of the rocker roller 112 on the rocking cam surface 152 toward the side of the non-acting face 152*a*. As a result, the lift amount of the intake valve 104 decreases. When the position of contact of the rocker roller 112 on the rocking cam surface 152 eventually changes from the acting face 152*b* to the non-acting face 152*a* as shown in FIG. 3A, the lift amount of the intake valve 104 becomes zero. Specifically, the intake valve 104 is closed.

(2) Lift Amount Change Operation of Variable Valve Mechanism

Figures 4A, 4B:
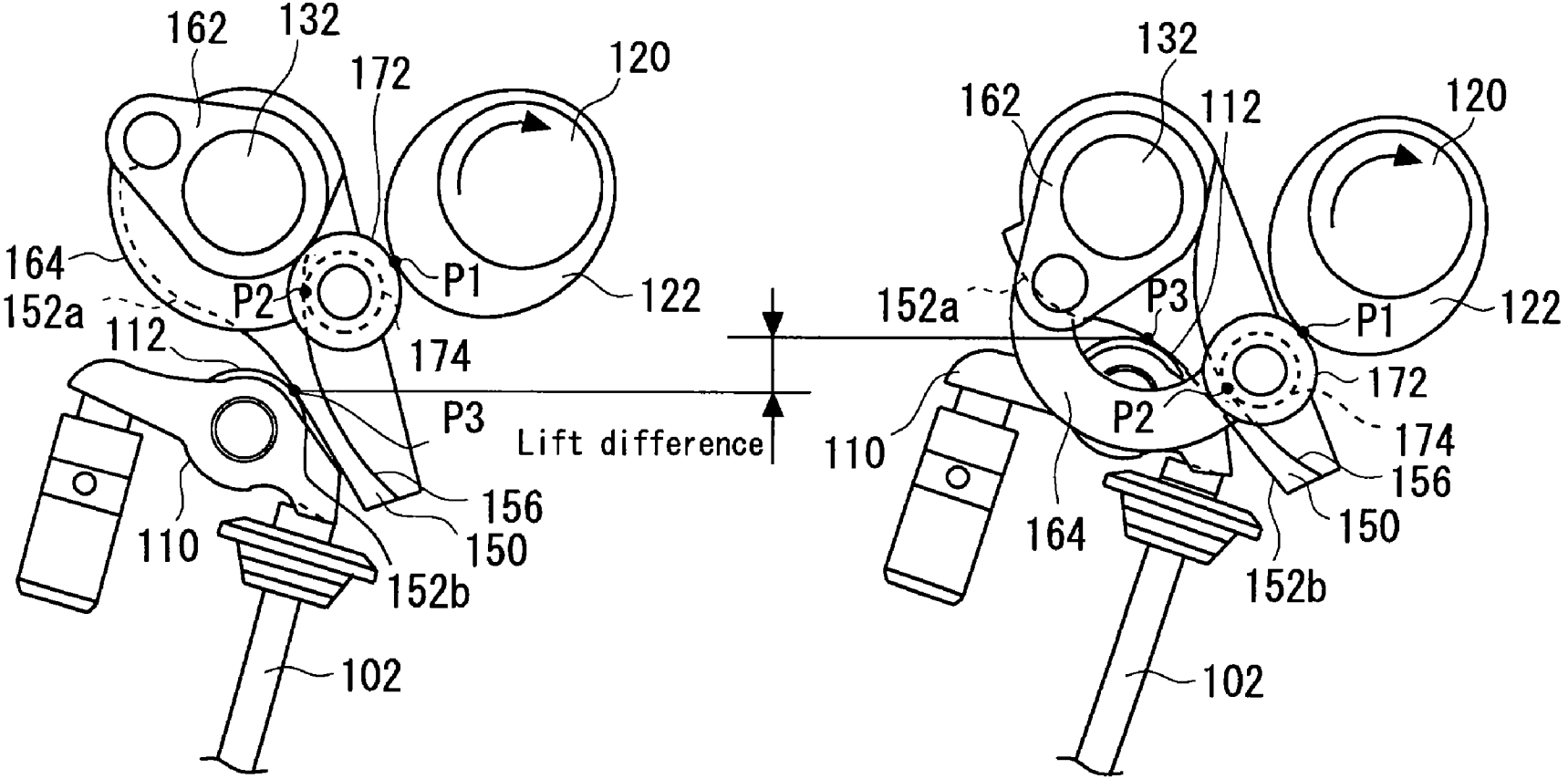
FIGS. 4A and 4B are views showing operations for changing a maximum lift amount of the variable valve mechanism, FIG. 4A showing a condition of a large lift and FIG. 4B showing a condition of a small lift.

The lift amount change operation of the variable valve mechanism 100 will be described with reference to FIGS. 4A and 4B. FIG. 4A is a view showing a condition of the variable valve mechanism 100 with the maximum lift amount, in which the variable valve mechanism 100 operates so as to give the intake valve 104 (omitted in FIG. 4A) a large lift. FIG. 4B is a view showing a condition of the variable valve mechanism 100 with the maximum lift amount, in which the variable valve mechanism 100 operates so as to give the intake valve 104 a small lift.

When the maximum lift amount is changed from the lift amount shown in FIG. 4A to that shown in FIG. 4B, the control shaft 132 is rotatably driven, in the condition shown in FIG. 4A, to rotate in a direction opposite to the rotating direction of the camshaft 120 (i.e., the counterclockwise direction in FIG. 4A). The control arm 162 is thereby rotated to an angular position shown in FIG. 4B. As the control arm 162 is rotated, the second roller 174 moves along the slide surface 156 in a direction away from the control shaft 132. At the same time, the first roller 172 moves along the cam 122 toward the upstream side in the direction of rotation of the cam 122. The control arm 162 and the link arm 164 constitute an operative coupling mechanism that varies the position of the second roller 174 on the slide surface 156 through operative coupling with rotation of the control shaft 132.

The second roller 174 moves in the direction away from the control shaft 132. This results in a longer distance between a rocking center of the rocking cam arm 150 and a position of contact P2 of the second roller 174 on the slide surface 156 and thus a reduced rocking angular range of the rocking cam arm 150. This is because the rocking angular range of the rocking cam arm 150 is inversely proportional to the distance between the rocking center and the position of contact P2 that is an input point of vibration. The reduction in the rocking angular range of the rocking cam arm 150 results in a final position of contact P3, to which the rocker roller 112 can reach, being moved on the acting face 152*b* toward the side of the non-acting face 152*a*. The maximum lift amount of the intake valve 104 is thereby reduced. An angle during which the rocker roller 112 remains disposed on the acting face 152*b*, serves as the acting angle of the intake valve 104. Movement of the final position of contact P3 to the side of the non-acting face 152*a* results in a reduced acting angle of the intake valve 104.

When the maximum lift amount is changed from the lift amount shown in FIG. 4B to that shown in FIG. 4A, on the other hand, the control shaft 132 is rotatably driven, in the condition shown in FIG. 4B, to rotate in the same direction as the rotating direction of the camshaft 120 (i.e., the clockwise direction in FIG. 4B). The control arm 162 is thereby rotated to an angular position shown in FIG. 4A. The second roller 174 then moves in a direction approaching the control shaft 132. As a result, the distance between the rocking center of the rocking cam arm 150 and the position of contact P2 of the second roller 174 on the slide surface 156 is shortened, thus increasing the rocking angular range of the rocking cam arm 150. The increase in the rocking angular range of the rocking cam arm 150 results in the final position of contact P3, to which the rocker roller 112 can reach, moving toward the side of a leading end of the acting face 152*b*. The maximum lift amount and the acting angle of the intake valve 104 are then increased.

Detailed Arrangement of Worm Gear Mechanism

The gear mechanism (worm gear mechanism) that transmits a driving force of the motor 10 to the control shaft 132 will be described in detail below.

Figure 5:
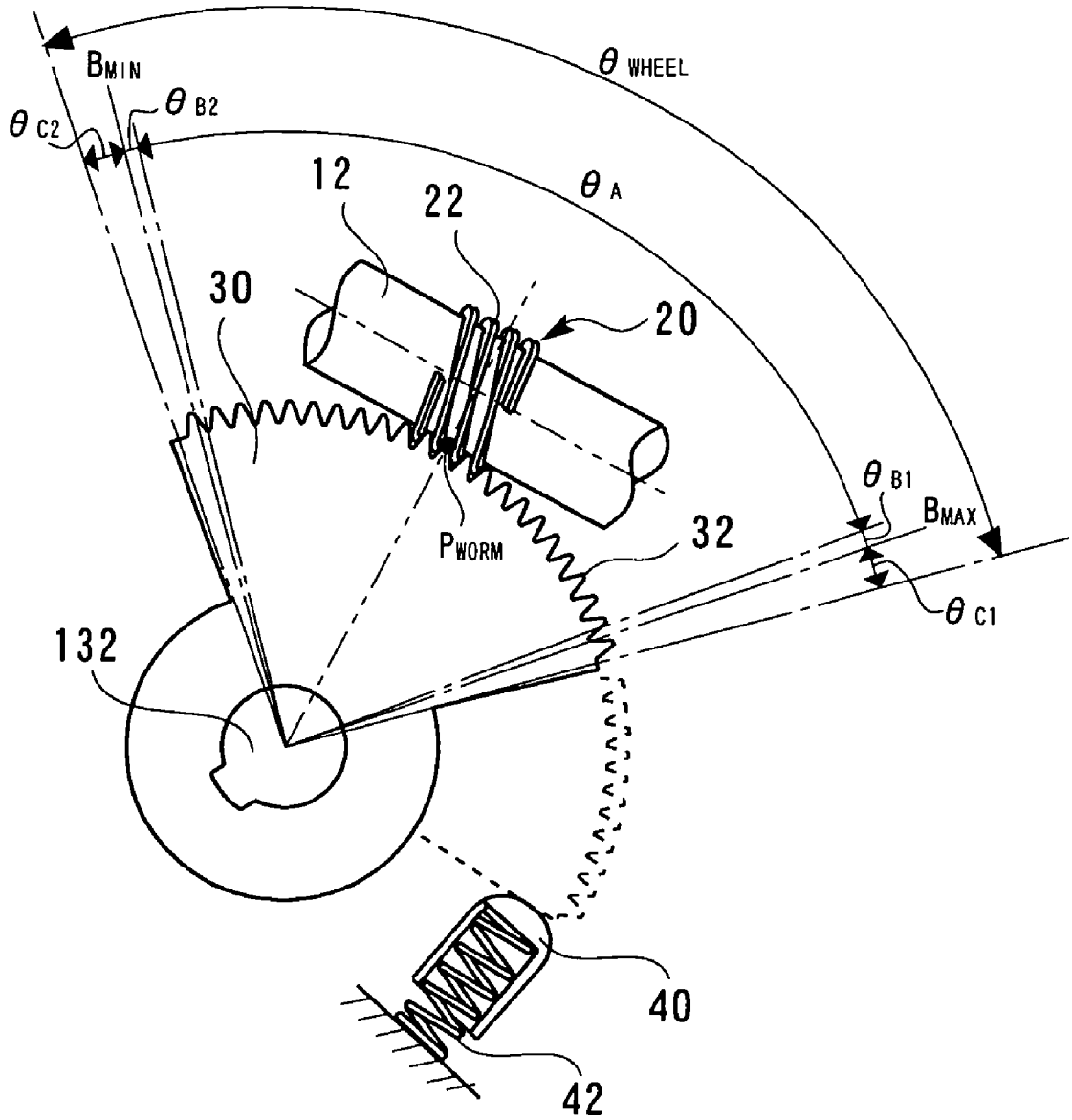
FIG. 5 is a view showing a worm gear mechanism as viewed from the direction of arrow B in FIG. 1.

FIG. 5 is a view showing the worm gear mechanism as viewed from the direction of arrow B (the direction opposite to that viewed in FIGS. 2 through 4B) that extends in parallel with the axis of the control shaft 132 in FIG. 1. As described earlier, the worm gear mechanism includes the worm gear 20 fixed to the output shaft 12 of the motor and the worm wheel 30 fixed to the control shaft 132. In FIG. 5, the more the control shaft 132 rotates in the clockwise direction, the less largely the maximum lift amount of the intake valve 104 is changed. Further, the more the control shaft 132 rotates in the counterclockwise direction, the more largely the maximum lift amount of the intake valve 104 is changed. In the following, rotation of the control shaft 132 in the clockwise direction is referred to as rotation in a small lift direction and rotation thereof in the counterclockwise direction is referred to as rotation in a large lift direction.

The worm wheel 30 according to the embodiment of the present invention is formed into a sector shape, and not a circular shape which is commonly found. Accordingly, the worm wheel 30 has teeth 32 formed only on a limited angular range $\theta_{WHEEL}$ thereof. The worm wheel 30 meshes with screw threads 22 of the worm gear 20 only within this limited angular range $\theta_{WHEEL}$ thereof. To state it another way, the worm wheel 30 is out of mesh with the worm gear 20 over any ranges outside this limited angular range $\theta_{WHEEL}$.

The above-referenced angular range $\theta_{WHEEL}$ includes a required rotational range $\theta_A$ of the control shaft 132, that is, an angular range of the control shaft 132 from an angular position that corresponds to a minimum setting value of the maximum lift amount of the intake valve 104 to an angular position that corresponds to a maximum setting value thereof. Rotation of the worm wheel 30 in the small lift direction causes a contact point (a contact point on a line extended in an orthogonal direction relative to an axis of the worm gear 20 and connecting the center of the worm wheel 30 with the shortest center distance) $P_{WORM}$ between the worm wheel 30 and the worm gear 20 to reach a small lift side boundary $B_{MIN}$ of the required rotational range $\theta_A$. At this time, the maximum lift amount of the intake valve 104 becomes the minimum setting value as shown in FIG. 4B. On the other hand, rotation of the worm wheel 30 in the large lift direction causes the aforementioned contact point to reach a large lift side boundary $B_{MAX}$ of the required rotational range $\theta_A$. At this time, the maximum lift amount of the intake valve 104 becomes the maximum setting value as shown in FIG. 4A.

The aforementioned angular range $\theta_{WHEEL}$ also includes adjustment margins $\theta_{B1}$, $\theta_{B2}$ set on corresponding ends on the outside on both sides of the required rotational range $\theta_A$. These adjustment margins $\theta_{B1}$, $\theta_{B2}$ are set to eliminate any discrepancies between a design value and an actual value of the required rotational range $\theta_A$ that occur as a result of dimensional errors in each element. The margin values are calculated based on tolerances of each element. An angular range of these adjustment margins $\theta_{B1}$, $\theta_{B2}$ added to the required rotational range $\theta_A$ represents a correct operating range of the control shaft 132. The ECU 60 controls rotation of the motor 10 such that the control shaft 132 rotates through this correct operating range.

The angular range $\theta_{WHEEL}$ further includes allowance ranges $\theta_{C1}$, $\theta_{C2}$ set outside the adjustment margins $\theta_{B1}$, $\theta_{B2}$. These allowance ranges $\theta_{C1}$, $\theta_{C2}$ represent an angular range until the worm wheel 30 no longer rotates after the contact point $P_{WORM}$ falls outside the correct operating range of the control shaft 132. When the control shaft 132 rotates in the large lift direction to exceed the correct operating range, the contact point $P_{WORM}$ enters the allowance range $\theta_{C1}$. As the contact point $P_{WORM}$ eventually exceeds the allowance range $\theta_{C1}$, the worm wheel 30 is out of mesh with the worm gear 20, thus causing the worm gear 20 to rotate idly. When, on the other hand, the control shaft 132 rotates in the small lift direction to exceed the correct operating range, the contact point $P_{WORM}$ enters the allowance range $\theta_{C2}$. As the contact point $P_{WORM}$ eventually exceeds the allowance range $\theta_{C2}$, the worm wheel 30 is out of mesh with the worm gear 20, thus causing the worm gear 20 to rotate idly.

Each of the aforementioned allowance ranges $\theta_{C1}$, $\theta_{C2}$ is set in consideration of, for example, deviation of a signal from the lift sensor 50. The ECU 60 determines the angular position of the control shaft 132 based on the signal from the lift sensor 50. Accordingly, if there is any deviation in the signal from the lift sensor 50, the following event could occur. Specifically, when the control shaft 132 is made to rotate to an angular position associated with the minimum setting value or the maximum setting value of the maximum lift amount, the control shaft 132 may be rotated to exceed slightly the above-referenced correct operating range. If the allowance ranges $\theta_{C1}$, $\theta_{C2}$ are set excessively largely, however, the variable valve mechanism 100 could be damaged by an excessively rotated control shaft 132, should the motor 10 rotate erratically because of a system failure or the like. In the worm wheel 30 according to the embodiment of the present invention, therefore, the allowance ranges $\theta_{C1}$, $\theta_{C2}$ are set as detailed below.

The allowance range $\theta_{C1}$ on the large lift side is set based on a maximum limit value of the maximum lift amount of the intake valve 104. The larger the maximum lift amount of the intake valve 104, the smaller a clearance between the intake valve 104 and a piston (not shown) when the valve is open. The maximum limit value refers to a limit value of the maximum lift amount, at which collision between the intake valve 104 and the piston can be avoided. The allowance range $\theta_{C1}$ is set such that the worm wheel 30 and the worm gear 20 are out of mesh with each other before the maximum lift amount reaches the above-referenced maximum limit value when the control shaft 132 rotates in the large lift direction to exceed the correct operating range.

The allowance range $\theta_{C2}$ on the small lift side is set based on a minimum limit value of the maximum lift amount of the intake valve 104. The smaller the maximum lift amount of the intake valve 104, the more the amount of air drawn into a combustion chamber is decreased. The minimum limit value refers to a limit value of the maximum lift amount required to achieve a marginal amount of intake air that allows an optimum operating condition of the internal combustion engine to be maintained. The allowance range $\theta_{C2}$ is set such that the worm wheel 30 and the worm gear 20 are out of mesh with each other before the maximum lift amount reaches the above-referenced minimum limit value when the control shaft 132 rotates in the small lift direction to exceed the correct operating range.

Each of the allowance ranges $\theta_{C1}$, $\theta_{C2}$ is set in consideration also of the position of the second roller 174 on the slide surface 156. When the control shaft 132 rotates in the large lift direction, the second roller 174 moves on the slide surface 156 toward the leading end position thereof. When the control shaft 132 rotates in the large lift direction, the second roller 174 moves on the slide surface 156 toward the trailing end position thereof. If the second roller 174 exceeds an extreme end of the slide surface 156 as a result of the control shaft 132 rotating excessively, the first roller 172 and the second rollers 174 fall out of a space between the cam 122 and the rocking cam arms 150. Accordingly, each of the allowance ranges $\theta_{C1}$, $\theta_{C2}$ is set such that the worm wheel 30 and the worm gear 20 are out of mesh with each other before the position of the second roller 174 on the slide surface 156 reaches the extreme end of the slide surface 156 when the control shaft 132 rotates to exceed the correct operating range.

The gear mechanism according to the embodiment of the present invention includes a shock absorber 40 for restricting rotation of the worm wheel 30 in the small lift direction. The shock absorber 40 is disposed in the small lift direction relative to the worm wheel 30 within a plane of rotation of the worm wheel 30. The shock absorber 40 is fixed to a stationary portion that the internal combustion engine includes. As shown by a dotted line in FIG. 5, when the worm wheel 30 rotates in the small lift direction, the worm wheel 30 is adapted to abut against a head portion of the shock absorber 40 before and after the contact point $P_{WORM}$ enters the allowance range $\theta_{C2}$ on the small lift side.

Operation and Effects of Gear Mechanism

Figure 6A:
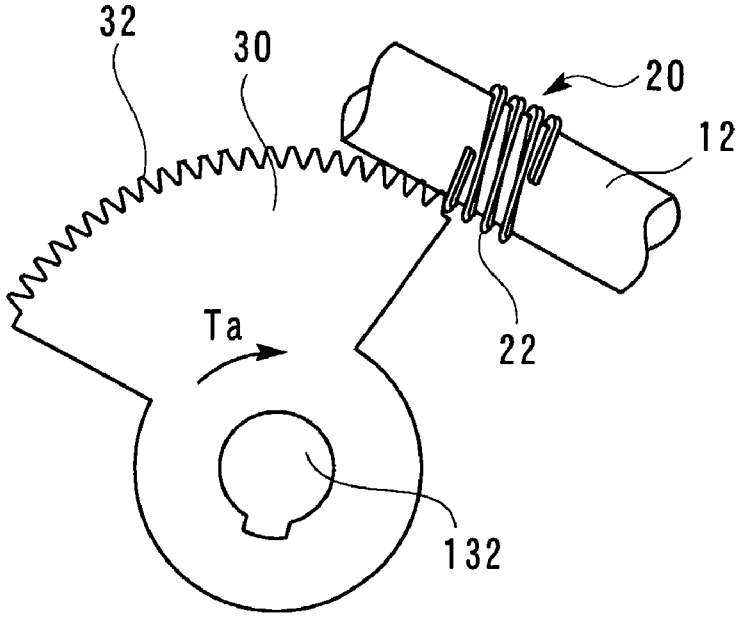
FIG. 6A is a view showing a condition, in which a control shaft rotates in a large lift direction to exceed a correct operating range in the arrangement shown in FIG. 5.
Figure 6B:
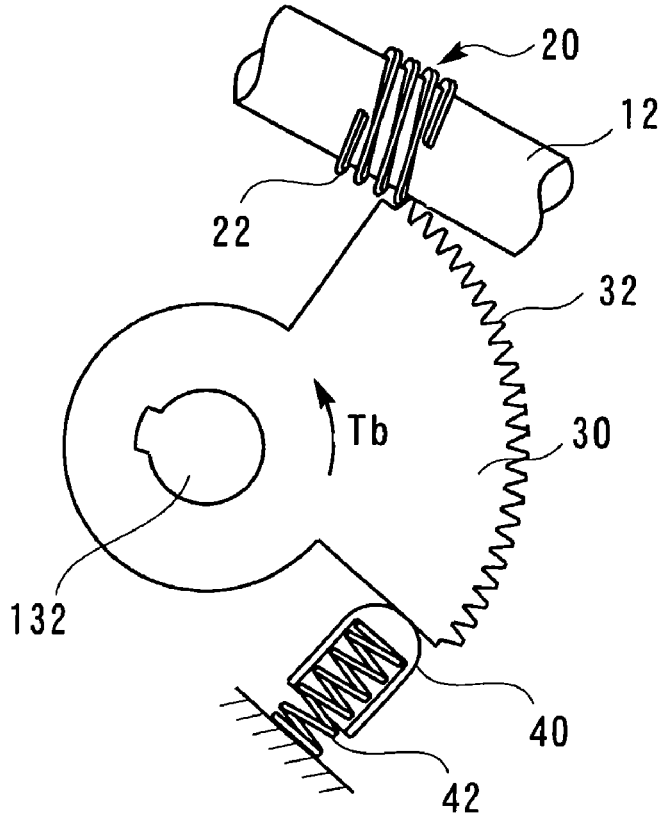
FIG. 6B is a view showing a condition, in which the control shaft rotates in a small lift direction to exceed the correct operating range in the arrangement shown in FIG. 5.

The operation and effects of the gear mechanism having the arrangements as described heretofore will be described with reference to FIGS. 6A and 6B.

A case will first be described, in which the control shaft 132 rotates in the large lift direction to exceed the correct operating range because of erratic rotation of the motor 10 as a result of a system failure or the like. As described earlier, the teeth 32 of the worm wheel 30 are formed only in the limited angular range $\theta_{WHEEL}$. Moreover, the allowance range $\theta_{C1}$ on the large lift side included in the limited angular range $\theta_{WHEEL}$ is set such that the worm wheel 30 and the worm gear 20 are out of mesh with each other before the maximum lift amount of the intake valve 104 reaches the maximum limit value. Accordingly, if the control shaft 132 rotates in the large lift direction to exceed the correct operating range, the worm wheel 30 and the worm gear 20 are out of mesh with each other, as shown in FIG. 6A, before the maximum lift amount of the intake valve 104 reaches the maximum limit value, thereby preventing the control shaft 132 from rotating any further. This prevents the maximum lift amount of the intake valve 104 from exceeding and becoming larger than the maximum limit value, thus avoiding a collision between the intake valve 104 and the piston.

A case will next be described, in which the control shaft 132 rotates in the small lift direction to exceed the correct operating range. As described earlier, the allowance range $\theta_{C2}$ on the small lift side included in the angular range $\theta_{WHEEL}$, over which the teeth 32 of the worm wheel 30 are formed, is set such that the worm wheel 30 and the worm gear 20 are out of mesh with each other before the maximum lift amount of the intake valve 104 reaches the minimum limit value. Accordingly, if the control shaft 132 rotates in the small lift direction to exceed the correct operating range, the worm wheel 30 and the worm gear 20 are out of mesh with each other, as shown in FIG. 6B, before the maximum lift amount of the intake valve 104 reaches the minimum limit value, thereby preventing the control shaft 132 from rotating any further. This prevents the maximum lift amount of the intake valve 104 from exceeding and becoming smaller than the minimum limit value. The marginal amount of intake air that allows the operating condition of the internal combustion engine to be maintained optimally can thereby be achieved.

The arrangement, in which the worm wheel 30 and the worm gear 20 are out of mesh with each other as described above, may indeed prevent the control shaft 132 from malfunctioning as a result of an excessive rotation thereof. It is, however, not possible to control the angular position of the control shaft 132 if the worm wheel 30 and the worm gear 20 are left out of mesh with each other. To resume operation of the variable valve mechanism 100 by letting the mechanism 100 recover from the failed state, it is necessary to allow the worm wheel 30 to be in mesh with the worm gear 20 once again so that rotation of the control shaft 132 can be controlled. In this respect, the gear mechanism according to the embodiment of the present invention allows the worm wheel 30 to be easily brought back into a state of being in mesh with the worm gear 20 as described below.

Torque produced from the reaction force of the lost motion spring and valve spring acts on the control shaft 132 at all times. This torque acts in a direction of closing the intake valve 104; specifically, in a direction of rotating the control shaft 132 in the small lift direction. The more the control shaft 132 is positioned at an angular position on the side of the large lift, the greater the magnitude of the torque. Accordingly, in the condition in which the worm wheel 30 and the worm gear 20 are out of mesh with each other because of an excessive rotation of the control shaft 132 in the large lift direction, a torque Ta in the small lift direction acts on the worm wheel 30. The torque Ta acts to press the worm wheel 30 up against the worm gear 20 at all times as shown in FIG. 6A, so that a condition is maintained, in which the teeth 32 of the worm wheel 30 are engaged with the screw threads 22 of the worm gear 20. Accordingly, rotating the motor 10 in the small lift direction allows the screw threads 22 of the worm gear 20 to pull the teeth 32 of the worm wheel 30, thus making the worm wheel 30 be in mesh with the worm gear 20 again. In the embodiment of the present invention, the lost motion spring and the valve spring correspond to a "first spring" according to an aspect of the present invention.

When the control shaft 132 rotates in the small lift direction, on the other hand, the torque produced from the reaction force of the lost motion spring and valve spring decreases. In the meantime, the worm wheel 30 abuts against the shock absorber 40, which causes torque generated from a reaction force of the shock absorber 40 to act on the control shaft 132. The magnitude of the torque generated from the shock absorber 40 is directly proportional to a compressed amount of a spring 42. The magnitude of the torque becomes greater with the control shaft 132 located at angular positions more on the small lift side. Accordingly, in the condition in which the worm wheel 30 and the worm gear 20 are out of mesh with each other because of an excessive rotation of the control shaft 132 in the small lift direction, a torque Tb in the large lift direction acts on the worm wheel 30. The torque Tb acts to press the worm wheel 30 up against the worm gear 20 at all times as shown in FIG. 6B, so that a condition is maintained, in which the teeth 32 of the worm wheel 30 are engaged with the screw threads 22 of the worm gear 20. Accordingly, rotating the motor 10 in the large lift direction allows the screw threads 22 of the worm gear 20 to pull the teeth 32 of the worm wheel 30, thus making the worm wheel 30 be in mesh with the worm gear 20 again. In the embodiment of the present invention, the spring 42 of the shock absorber 40 corresponds to a "second spring" according to another aspect of the present invention.

As described in the foregoing, according to the gear mechanism in accordance with the embodiment of the present invention, the worm wheel 30 can be urged in a direction opposite to the direction of rotation of the worm wheel 30 according to the amount of rotation thereof by using the reaction force of the lost motion spring or valve spring during rotation of the control shaft 132 in the large lift direction and using that of the spring 42 during rotation of the control shaft 132 in the small lift direction. This prevents an excessive force from acting on the worm wheel 30 and the worm gear 20 when the worm wheel 30 and the worm gear 20 are in mesh with each other. Further, the worm wheel 30 and the worm gear 20 can be reliably brought back into mesh with other when the two are out of mesh with each other.

Second Embodiment

A second embodiment of the present invention will be described below with reference to FIGS. 7A, 7B, and 8.

A variable valve mechanism according to the second embodiment of the present invention is characterized in that an arrangement for correcting deviation of a signal from a lift sensor 50 is newly added to the basic structure of the arrangements according to the first embodiment of the present invention. In each of FIGS. 7A, 7B, and 8, like reference numerals refer to like parts and duplicate descriptions will be omitted or simplified.

Figure 7A:
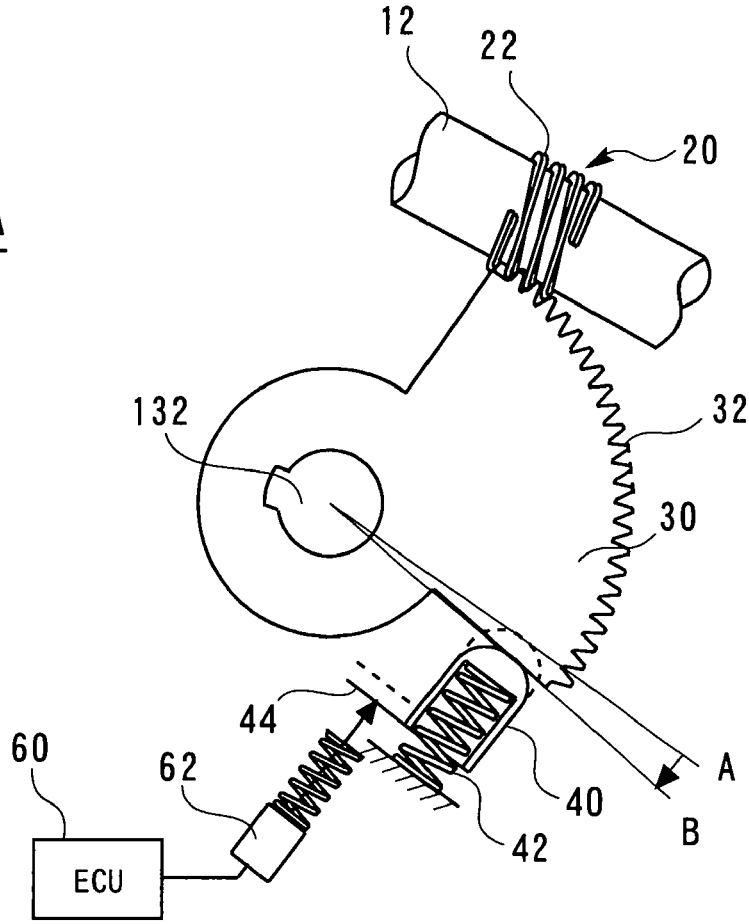
FIG. 7A is a view showing a worm gear mechanism according to a second embodiment of the present invention as viewed from the direction of arrow B of FIG. 1.

FIG. 7A is a view showing a worm gear mechanism according to the second embodiment of the present invention as viewed from the direction of arrow B of FIG. 1. FIG. 7A corresponds to FIG. 5 according to the first embodiment of the present invention. Referring to FIG. 7A, a shock absorber 40 includes a lever 44 newly added thereto. The lever 44 is fixed to the shock absorber 40. When a worm wheel 30 abuts on the shock absorber 40, therefore, the lever 44 is displaced integrally with the shock absorber 40 according to the amount of rotation of the worm wheel 30.

A reference switch 62 is disposed along a trajectory of movement of the lever 44. The reference switch 62 is connected to an ECU 60. A signal from the reference switch 62 is outputted to the ECU 60 at all times. The signal from the reference switch 62 turns on from an off state according to abutment of the lever 44. In FIG. 7A, when the worm wheel 30 rotates in the small lift direction, the worm wheel 30 abuts on the shock absorber 40. The angular position of the worm wheel 30 at this time is referred to as "A." When the worm wheel 30 is located at the angular position A and the shock absorber 40 and the lever 44 are located at a position indicated by a dotted line, the signal of the reference switch 62 is off. As the worm wheel 30 further rotates in the small lift direction to reach the angular position of "B" in FIG. 7A and the lever 44 then contacts the reference switch 62 as shown by a solid line in FIG. 7A, the signal of the reference switch 62 turns on. The angular position B is set so as to be achieved when a control shaft 132 is in the correct operating range.

Figure 7B:
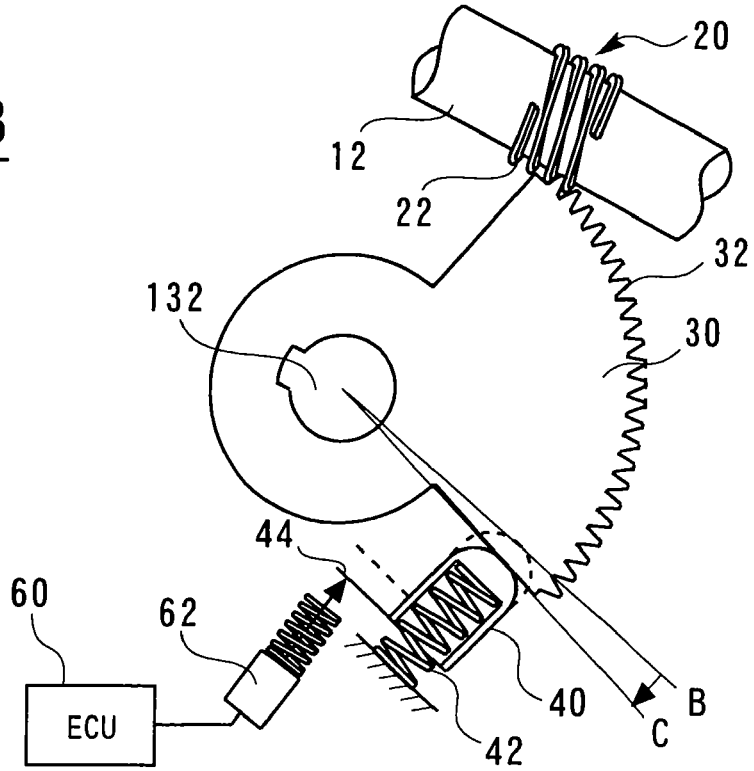
FIG. 7B is a view showing a condition, in which the control shaft rotates in the small lift direction to exceed the correct operating range in the arrangement shown in FIG. 7A.

FIG. 7B is a view showing a condition, in which the worm wheel 30 further rotates in the small lift direction, so that the worm wheel 30 and a worm gear 20 are out of mesh with each other. In this condition, the angular position of the worm wheel 30 is "C" in FIG. 7B. The angular position "B" of the worm wheel 30 shown in FIG. 7B corresponds to position B in FIG. 7A. With the worm wheel 30 at the angular position B, the shock absorber 40 and the lever 44 are located at positions indicated by a dotted line in FIG. 7B. While the worm wheel 30 rotates from angular position B to angular position C, the reference switch 62 is kept pressed by the lever 44. The signal from the reference switch 62 is therefore kept on.

Figure 8:
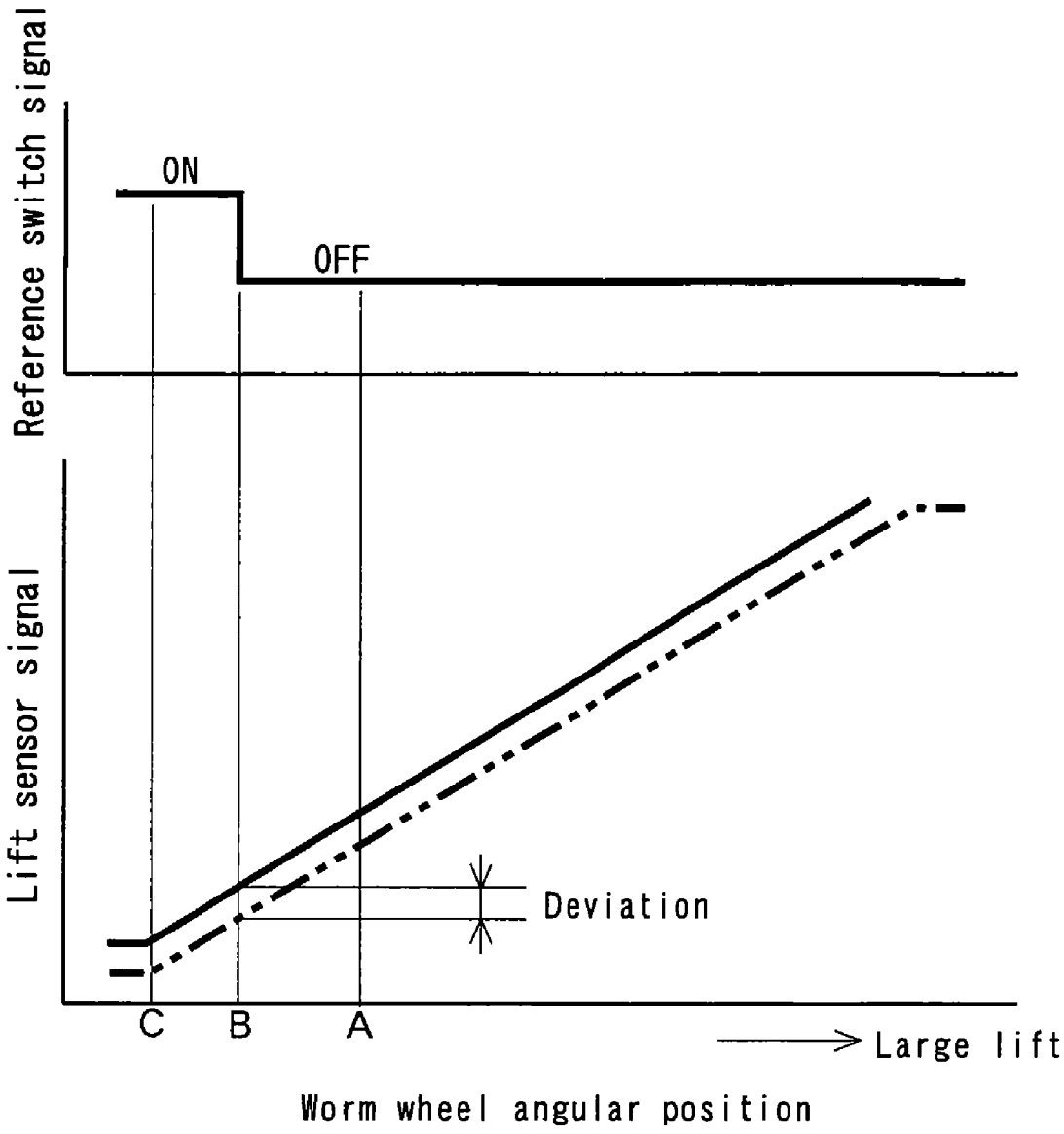
FIG. 8 is a diagram showing changes in a signal from a reference switch and changes in a signal from a lift sensor relative to an angular position of a worm wheel.

FIG. 8 is a diagram showing changes in the signal from the reference switch 62 and changes in the signal from the lift sensor 50 relative to the angular position of a worm wheel 30. The angular position of the worm wheel 30 has one-to-one correspondence with a maximum lift amount of an intake valve 104. As described above, the signal of the reference switch 62 is off when the angular position of the worm wheel 30 is located at a position on the large lift side relative to position B. Further, the signal is on when the angular position of the worm wheel 30 is located at a position on the small lift side relative to position B. The signal of the lift sensor 50, on the other hand, changes in direct proportion to the angular position of the worm wheel 30. The signal becomes greater as the angular position is more on the large lift side. The ECU 60 determines the current angular position of the worm wheel 30 (angular position of the control shaft 132) using the signal from the lift sensor 50. The ECU 60 then controls rotation of a motor 10 such that the angular position of the worm wheel 30 coincides with a target angular position as determined from an operating condition of an internal combustion engine and the like.

The reference switch 62 is a simple structure having its signal turned on or off. If the reference switch 62 is properly installed, there is no likelihood that deviation occurs in the signal relative to the angular position of the worm wheel 30. With the lift sensor 50, however, a voltage drop or other effect can produce deviation in the signal. For example, referring to FIG. 8, an actual signal indicated by a solid line may be deviated toward the small lift side with reference to a design signal shown by a dash-double-dot line. If there is deviation in the signal from the lift sensor 50 as shown above, an error results in the maximum lift amount of the intake valve 104 controlled based on this signal.

The ECU 60 therefore corrects the signal of the lift sensor 50 with reference to the signal of the reference switch 62. More specifically, the signal of the lift sensor 50 is measured at a time that the signal of the reference switch 62 is turned on from the off state. Any deviation of the thus measured signal from the design signal ("deviation in signal" shown in FIG. 8) is set as a correction signal for correcting the signal of the lift sensor 50. This makes the signal of the lift sensor 50 that has undergone the correction coincide with the design signal. It therefore becomes possible to control the angular position of the control shaft 132 based on accurate position information.

As described in the foregoing, according to the second embodiment of the present invention, the signal of the lift sensor 50 is corrected with reference to the change in the signal of the reference switch 62 when rotation of the motor 10 is controlled based on the signal of the lift sensor 50. Deviation in the angular position of the control shaft 132 as affected by deviation in the signal of the lift sensor 50 can therefore be prevented. Accordingly, should there be deviation produced in the signal of the lift sensor 50 as affected by a voltage drop or the like, an error can be prevented from occurring in controlling the maximum lift amount of the intake valve 104, which would otherwise be caused as a result of the deviation. In addition, it is also possible to prevent the control shaft 132 from rotating to exceed the correct operating range, which would otherwise be caused as a result of the deviation in the signal of the lift sensor 50.

Third Embodiment

A third embodiment of the present invention will be described below with reference to FIG. 9.

A variable valve mechanism according to the third embodiment of the present invention is characterized in that the mechanism allows deviation of a signal of a lift sensor 50 to be corrected without adding any new arrangement to the structure of the arrangements according to the first embodiment of the present invention.

Figure 9:
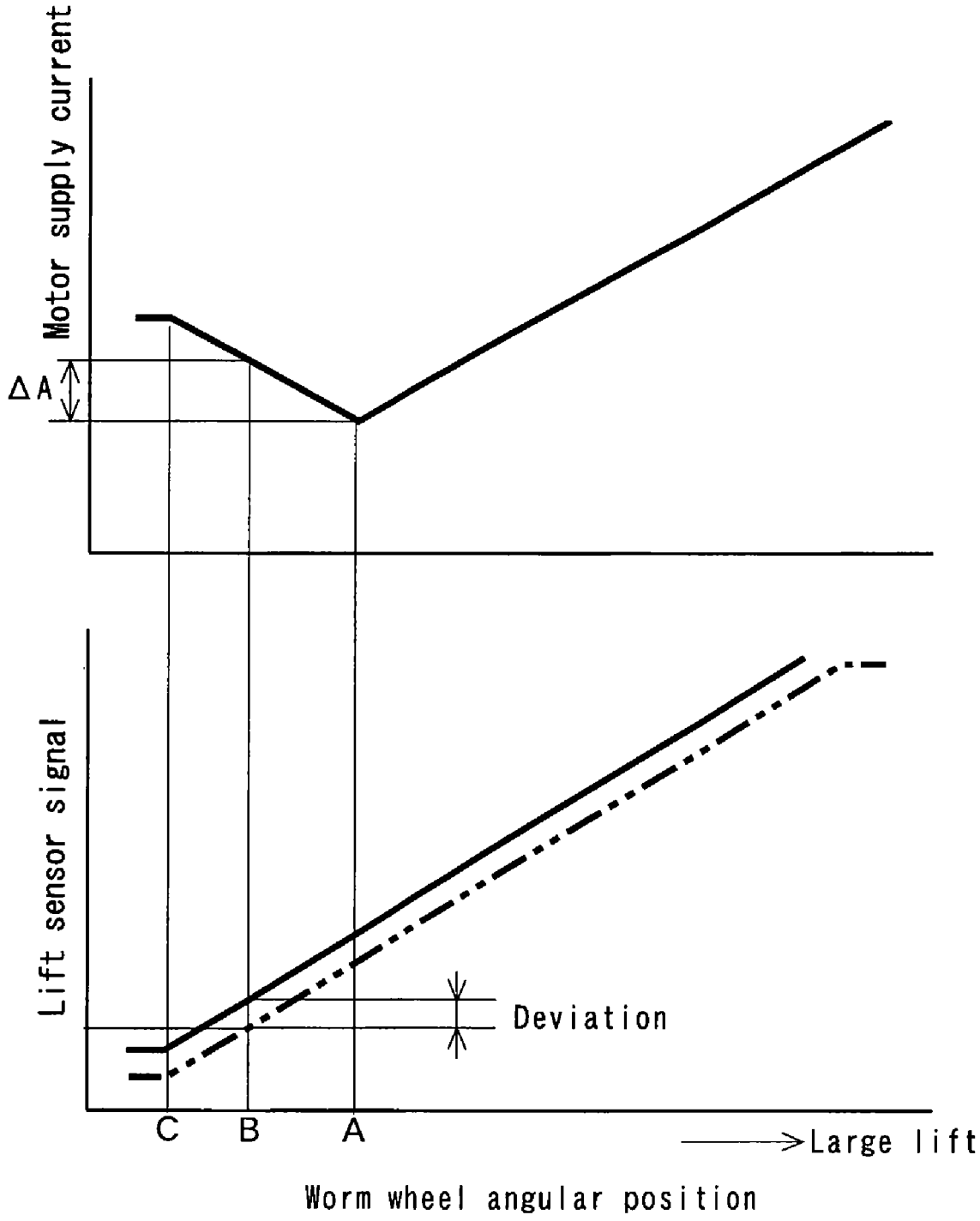
FIG. 9 is a diagram showing changes in the magnitude of a supply current fed to a motor and changes in the signal from the lift sensor relative to the angular position of the worm wheel.

FIG. 9 is a diagram showing changes in the magnitude of a supply current fed to a motor 10 and changes in the signal from the lift sensor 50 relative to the angular position of a worm wheel 30. Angular positions A, B, and C indicated on the abscissa of FIG. 9 correspond, respectively, to the angular positions A, B, and C of the worm wheel 30 exemplified in the second embodiment of the present invention. Referring to FIG. 9, the motor supply current decreases gradually as the angular position of the worm wheel 30 changes toward the small lift side. This is because of the following reason. Specifically, with reaction forces of a lost motion spring and a valve spring decreasing, a driving force required of the motor 10 decreases. If the angular position of the worm wheel 30 is on the small lift side more than the angular position A, however, the motor supply current gradually increases. This is the reason why with the worm wheel 30 at an angular position more on the small lift side than the angular position A, the reaction force of a shock absorber 40 acts on the worm wheel 30.

The motor supply current is directly proportional to the driving force required of the motor 10. The driving force required of the motor 10 is defined by the angular position of a control shaft 10. Assuming that the relationship between the motor supply current and the driving force, and that between the required driving force and the angular position of the control shaft 10, are constant, it may be safe to assume that the relationship between the motor supply current and the angular position of the control shaft 10 (angular position of the worm wheel 30) is constant. According to the third embodiment of the present invention, the motor supply current is used as a reference signal for correcting deviation of the signal from the lift sensor 50. A method of correcting deviation of the signal from the lift sensor 50 according to the third embodiment of the present invention will be described below.

The motor supply current becomes the minimum value when the worm wheel is located at the angular position A, that is, when the worm wheel 30 abuts on the shock absorber 40. As the worm wheel 30 rotates further in the small lift direction to be located at the angular position B, the motor supply current increases by ΔA than the minimum value. An ECU 60 uses this difference in current ΔA for correcting the signal of the lift sensor 50. More specifically, the signal of the lift sensor 50 when the motor supply current increases from the minimum value to the difference in current ΔA is measured and the signal of the lift sensor 50 is corrected by using, as a correction signal, the deviation between the measured signal and the design signal ("deviation in signal" shown in FIG. 9). This makes the signal of the lift sensor 56 after the correction coincide with the design signal. The angular position of the control shaft 132 can thereby be controlled based on accurate position information.

As described heretofore, according to the third embodiment of the present invention, the signal of the lift sensor 50 is corrected with reference to changes in the motor supply current when rotation of the motor 10 is controlled based on the signal of the lift sensor 50. As in the second embodiment of the present invention, therefore, deviation in the angular position of the control shaft 132 as affected by deviation in the signal of the lift sensor 50 can be prevented. Moreover, the third embodiment of the present invention offers the advantage of achieving the same effect as that derived from the second embodiment of the present invention without including any new reference switches in the mechanism.

MISCELLANEOUS

The present invention has been described with reference to specific embodiments that are to be considered as only illustrative and not restrictive, and the present invention is not to be limited to the details given herein, but can be implemented in various manners without departing from the spirit thereof. For instance, the variable valve mechanism according to the present invention may also be applied to an exhaust valve, in addition to the intake valve, in which the present invention is embodied.

The invention claimed is:

1. A variable valve mechanism for an internal combustion engine, comprising:

a variable mechanism for varying a maximum lift amount of a valve according to an angular position of a control shaft; and an actuator connected to the control shaft via a worm gear mechanism, the variable valve mechanism varying the maximum lift amount of the valve by rotatably driving the control shaft via the worm gear mechanism using the actuator;

wherein the worm gear mechanism includes a worm gear connected to the actuator and a worm wheel connected to the control shaft;

wherein the worm wheel has teeth that are in mesh with the worm gear over a predetermined angular range including a required rotational range of the control shaft and is formed to be brought out of mesh with the worm gear outside the predetermined angular range;

wherein the required rotational range of the control shaft includes an angular range of the control shaft ranging from an angular position that corresponds to a minimum setting value of the maximum lift amount of the valve to an angular position that corresponds to a maximum setting value thereof; and wherein the predetermined angular range is set such that, when the control shaft rotates in a small lift direction to exceed the angular position associated with the minimum setting value, the worm wheel and the worm gear are brought out of mesh with each other before the maximum lift amount of the valve reaches a minimum limit value required for achieving a marginal amount of intake air that allows an optimum operating condition of the internal combustion engine to be maintained.

2. The variable valve mechanism according to claim 1, wherein the variable mechanism includes:

a rocking member that rocks about an axis disposed in parallel with a camshaft;

a rocking cam surface formed on the rocking member, the rocking cam surface coming in contact with a valve support member supporting the valve to press the valve in a lift direction;

a slide surface formed on the rocking member so as to oppose to a cam;

an intermediate member sandwiched between the cam and the slide surface; and an operative coupling mechanism that varies a position of the intermediate member on the slide surface through operative coupling with rotation of the control shaft, wherein the predetermined angular range is set such that the worm wheel and the worm gear are brought out of mesh with each other before the position of the intermediate member on the slide surface reaches an extreme end of the slide surface when the control shaft rotates to exceed the required rotational range.

3. The variable valve mechanism according to claim 1, further including:

an urge means for urging the worm wheel toward a side, in which teeth of the worm wheel are engaged with the worm gear, if the worm wheel and the worm gear are brought out of mesh with each other as a result of an excessive rotation of the worm wheel.

4. The variable valve mechanism according to claim 3, wherein the urge means includes:

a first spring that urges the worm wheel in the small lift direction with a spring force according to an amount of rotation of the worm wheel in the large lift direction; and a second spring that urges the worm wheel in the large lift direction with a spring force according to an amount of rotation of the worm wheel in the small lift direction.

5. The variable valve mechanism according to claim 1, further including:

an angular position sensor for producing an output of a signal in response to an angular position of the control shaft;

a control means for controlling the actuator such that the angular position of the control shaft is made to coincide with a target angular position based on the signal of the angular position sensor;

a switch a signal of which is changed before and after a predetermined reference angular position when the control shaft rotates; and a correction means for correcting the signal of the angular position sensor based on deviation between a signal to be outputted from the angular position sensor when the control shaft is at the reference angular position and a signal actually outputted from the angular position sensor when the signal of the switch changes.

6. The variable valve mechanism according to claim 1, further including:

an angular position sensor for producing an output of a signal in response to an angular position of the control shaft;

a control means for controlling the actuator such that the angular position of the control shaft is made to coincide with a target angular position based on the signal of the angular position sensor; and a correction means for correcting the signal of the angular position sensor based on the relationship between the magnitude of a power supplied to the actuator and the signal of the angular position sensor.

7. A variable valve mechanism for an internal combustion engine, comprising:

a variable mechanism for varying a maximum lift amount of a valve according to an angular position of a control shaft; and an actuator connected to the control shaft via a worm gear mechanism, the variable valve mechanism varying the maximum lift amount of the valve by rotatably driving the control shaft via the worm gear mechanism using the actuator;

wherein the worm gear mechanism includes a worm gear connected to the actuator and a worm wheel connected to the control shaft;

wherein the worm wheel has teeth that are in mesh with the worm gear over a predetermined angular range including a required rotational range of the control shaft and is formed to be brought out of mesh with the worm gear outside the predetermined angular range;

wherein the required rotational range of the control shaft includes an angular range of the control shaft ranging from an angular position that corresponds to a minimum setting value of the maximum lift amount of the valve to an angular position that corresponds to a maximum setting value thereof; and wherein the predetermined angular range is set such that, when the control shaft rotates in a large lift direction to exceed the angular position associated with the maximum setting value, the worm wheel and the worm gear are brought out of mesh with each other before the maximum lift amount of the valve reaches a maximum limit value that can prevent a collision between the valve and a piston.

8. The variable valve mechanism according to claim 7, wherein the variable mechanism includes:

a rocking member that rocks about an axis disposed in parallel with a camshaft;

a rocking cam surface formed on the rocking member, the rocking cam surface coming in contact with a valve support member supporting the valve to press the valve in a lift direction;

a slide surface formed on the rocking member so as to oppose to a cam;

an intermediate member sandwiched between the cam and the slide surface; and an operative coupling mechanism that varies a position of the intermediate member on the slide surface through operative coupling with rotation of the control shaft, wherein the predetermined angular range is set such that the worm wheel and the worm gear are brought out of mesh with each other before the position of the intermediate member on the slide surface reaches an extreme end of the slide surface when the control shaft rotates to exceed the required rotational range.

9. The variable valve mechanism according to claim 7, further including:

an urge means for urging the worm wheel toward a side, in which teeth of the worm wheel are engaged with the worm gear, if the worm wheel and the worm gear are brought out of mesh with each other as a result of an excessive rotation of the worm wheel.

10. The variable valve mechanism according to claim 9, wherein the urge means includes:

a first spring that urges the worm wheel in the small lift direction with a spring force according to an amount of rotation of the worm wheel in the large lift direction; and a second spring that urges the worm wheel in the large lift direction with a spring force according to an amount of rotation of the worm wheel in the small lift direction.

11. The variable valve mechanism according to claim 7, further including:

an angular position sensor for producing an output of a signal in response to an angular position of the control shaft;

a control means for controlling the actuator such that the angular position of the control shaft is made to coincide with a target angular position based on the signal of the angular position sensor;

a switch a signal of which is changed before and after a predetermined reference angular position when the control shaft rotates; and a correction means for correcting the signal of the angular position sensor based on deviation between a signal to be outputted from the angular position sensor when the control shaft is at the reference angular position and a signal actually outputted from the angular position sensor when the signal of the switch changes.

12. The variable valve mechanism according to claim 7, further including:

an angular position sensor for producing an output of a signal in response to an angular position of the control shaft;

a control means for controlling the actuator such that the angular position of the control shaft is made to coincide with a target angular position based on the signal of the angular position sensor; and a correction means for correcting the signal of the angular position sensor based on the relationship between the magnitude of a power supplied to the actuator and the signal of the angular position sensor.

* * * * *